United States Patent [19]

Cook et al.

[11] 4,232,983

[45] Nov. 11, 1980

[54] OFFSHORE SUBMARINE STORAGE FACILITY FOR HIGHLY CHILLED LIQUIFIED GASES

[75] Inventors: Sidney F. Cook, 2800 Jefferson Way SW., Corvallis, Oreg. 97330; Mark Stolowitz, 6924 Plymouth #99, Stockton, Calif. 95207

[73] Assignees: Sidney F. Cook; Mark L. Stolowitz, both of Corvallis, Oreg.

[21] Appl. No.: 967,472

[22] Filed: Dec. 7, 1978

[51] Int. Cl.[3] ..... B63B 35/00; E02B 17/00; F17C 1/12

[52] U.S. Cl. ..... 405/210; 62/45; 114/257; 220/8; 405/200; 405/205

[58] Field of Search ..... 405/196, 200, 205, 210; 62/45; 114/256, 257; 220/8, 435, 436

[56] References Cited

U.S. PATENT DOCUMENTS

| | | | |
|---|---|---|---|
| 2,350,883 | 6/1944 | Duttweiler | 405/210 X |
| 2,947,437 | 8/1960 | Greer | 405/210 X |
| 3,659,108 | 4/1972 | Quase | 220/8 X |
| 3,727,418 | 4/1973 | Glazier | 62/45 |
| 3,828,565 | 8/1974 | McCabe | 62/45 |
| 3,837,310 | 9/1974 | Toyama | 405/210 X |
| 4,060,995 | 12/1977 | Lacroix et al. | 405/200 |
| 4,136,997 | 1/1979 | Chapman | 405/210 |

*Primary Examiner*—David H. Corbin

*Attorney, Agent, or Firm*—Owen, Wickersham & Erickson

[57] ABSTRACT

An offshore submarine storage facility for highly chilled liquified gas, such as liquified natural gas, is disclosed. The facility includes an elongated, vertically oriented submerged frame. An insulated storage tank is movably mounted to the frame so as to be positionable at various depths in the water. The tank is constructed to transfer external ambient water pressure to the liquified gas without intermixture. This transferred pressure aids in maintaining the liquified state of the stored liquified gas.

12 Claims, 6 Drawing Figures

FIG. 2
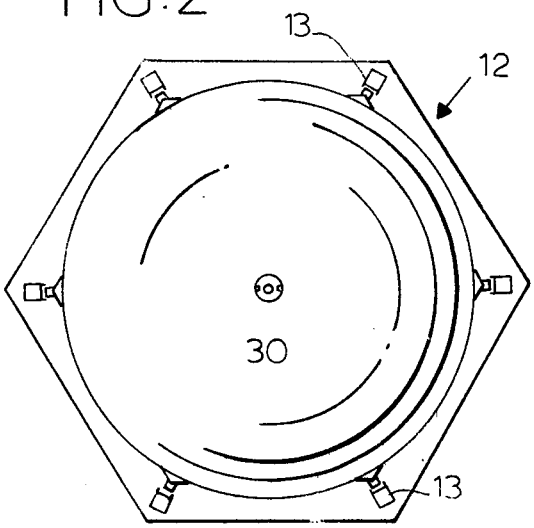
FIG. 4
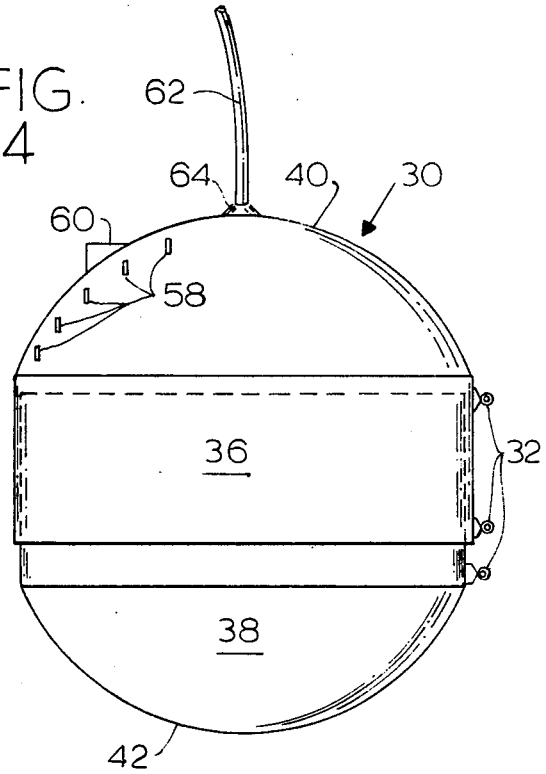
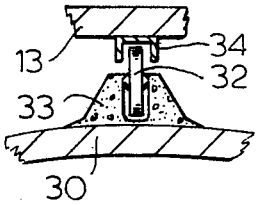
FIG. 3
FIG. 5
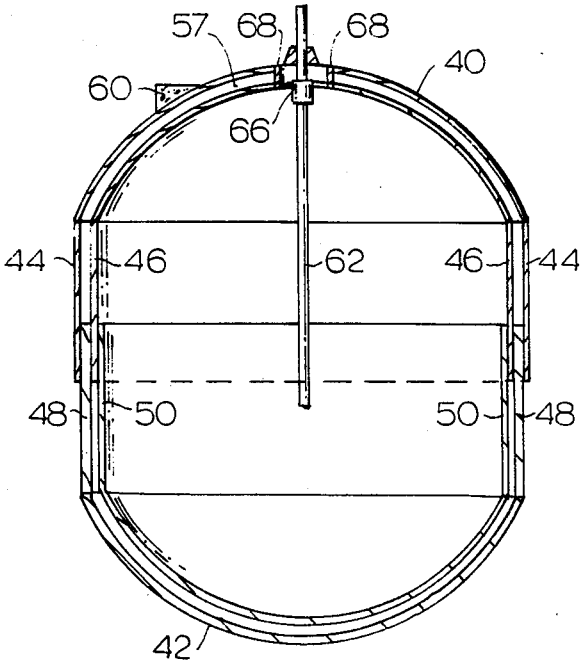
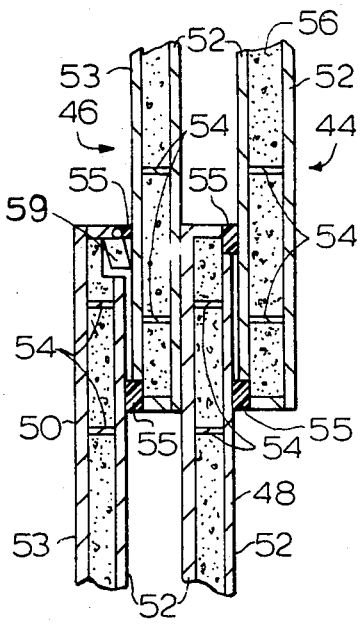
FIG. 6

OFFSHORE SUBMARINE STORAGE FACILITY FOR HIGHLY CHILLED LIQUIFIED GASES

BACKGROUND OF THE INVENTION

The present invention relates to storage facilities for highly chilled liquified gases. More particularly, the present invention relates to offshore terminal and submarine storage facilities for liquified energy gases, including liquified natural gas (LNG).

It has been long known to liquify gases, including natural gas, to reduce volume and thereby facilitate transportation and storage. A significant drawback stemming from the liquification and concomitant concentration of high energy gases is the vastly increased threat to safety and potential for devastation.

A liquid natural gas disaster occurred in the Cleveland, Ohio vicinity in 1944 in which hundreds of people were killed and injured. This disaster effectively terminated the use of liquified natural gas in the United States for the next twenty years.

On the other hand, liquid petroleum gases (LPG) such as propane and butane, have been in widespread uses in both rural and industrial energy applications throughout the United States for many years. Man-made, synthetic gases are also known and used for energy and other useful purposes. As local natural gas supplies dwindle, transported and stored liquid energy gases will become an increasingly significant source of energy throughout the world. These liquified gases are of three basic types: natural (LNG), petroleum (LPG), and synthetic (LSG) including artificially produced domestic energy gases (i.e., methane and ethane) and industrial energy gases (i.e., acetylene and propylene). These liquified gases will be a primary source of heat producing energy for the near range future, certainly during the interim until solar, geothermal and fusion energy sources are made practical and economical. Also, of the remaining, readily available energy sources (i.e, coal, oil, gasoline, uranium and gas), only the liquified energy gases burn cleanly, which renders them attractive alternatives as soceity becomes increasingly concerned with the prevention of air pollution.

Natural gas is a mixture of hydrocarbons, typically 65 to 99 percent methane, with smaller amounts of ethane, propane and butane. When natural gas is chilled to below minus 263 degrees Fahrenheit, it becomes an odorless, colorless liquid having a volume which is less than one six hundredth (1/600) of its volume at ambient atmospheric surface temperature and pressure. When LNG is warmed above its −263° F. boiling point, it boils (i.e., regassifies) and expands to its over six hundred times greater original volume. Thus, it will be appreciated that a 150,000 cubic meter LNG tanker ship is capable of carrying the equivalent of 3.2 billion cubic feet of natural gas.

Of the known liquid energy gases, liquid natural gas is the most difficult to handle because it is so intensely cold. Complex handling, shipping and storage apparatus and procedures are required to prevent unwanted thermal rise in the LNG and resultant regassification. Storage vessels, whether part of LNG tanker ships or land-based, are closely analogous to giant thermos bottles with outer walls, inner walls and effective types and amounts of insulation in between.

LNG storage tanks in the United States have heretofor been built mostly aboveground with some frozen pit facilities properly characterized as mostly above ground. Most such tanks have been enclosed by surrounding earthen dikes. Such dikes were sized and emplaced to enclose an area and volume at least as great as the storage capacity of the largest tank within the diked area. Besides the known potential hazards of explosion and inferno created by massive rupture of such tanks, a small rupture, as by a saboteur's bullet or projectile in the upper part of the sidewall could result in a stream of LNG shooting beyond the dike, thereby rendering it useless to contain the hazard of a spill and creating the consequent likelihood of explosion and fiery inferno.

The hazards presented by liquid energy gas storage facilities to adjacent population concentrations are so great that the Controller General of the United States has recommended to Congress that all "future facilities for storing large quantities of these gases should be built in remote areas." This recommendation, as well as others, appeared on the front cover of Volume 1 of a comprehensive three volume Controller General Report to the Congress entitled *Liquified Energy Gases Safety, document No. EMD*-78-28, issued July 31, 1978. Great public controversy has erupted about the proposed establishment of additional onshore LNG storage facilities, regardless of actual remoteness to populated areas.

Surprisingly, little public attention has heretofore focused upon the ocean and its vastness as a potentially safer environment for storage facilities for liquified energy gases, including LNG. A partially submerged offshore storage tank for liquified energy gases was disclosed in the Jackson U.S. Pat. No. 3,675,431, issued July 11, 1972. That patent described an insulated tank which was prefabricated, floated to a suitable offshore site and then sunk until its submerged base rested on the floor of the sea. An upper above-the-water domed metal cylinder extended from the concrete base. Insulation lined the interior of the tank. A thin and flexible membrane inside the insulation provided the required liquid tight interior lining of the tank. The insulation lining the submerged portion of the tank was said to be thinned, so that a layer of ice formed around the outside of the concrete base when the tank was filled with liquified gas. In accordance with the invention claimed in the patent, the ice layer supposedly acted as an outer seal for the submerged concrete.

Subterranean storage vessels for LNG have been used in Japan with some claimed advantages over surface, landbased storage facilities. Nevertheless, the hazards presented by such facilities, particularly from earthquake damage, remain unabated. Also, inspecting and maintaining such facilities was extremely difficult and hazardous.

Another prior proposal for offshore underwater storage of crude petroleum product was described in the Pogonowski U.S. Pat. No. 3,643,447, issued Feb. 22, 1972. Therein, a frame anchored to the sea floor supported an expansible, bladder-like tank held to the frame at a predetermined depth below the surface. Crude petroleum from an undersea well was piped into the tank continuously and caused it to expand. A delivery conduit from the tank extended to the surface and delivered the crude into tanks of an awaiting barge or ship. Latent hydrostatic lifting pressure developed by sea pressure against the flexible tank was used to force the crude out of the bladder-like tank, through the conduit, and into the awaiting tanker without pumping being required. While the Pogonowski contrivance might have been feasible for storage of liquid crude at ambient sea temperature, there is no suggestion in that reference of the suitability of its subject matter for storage of liquified energy gases and other liquids at low temperatures, the use of ambient water pressure to maintain the liquid state of the liquified gas, or the use of depth in the water to dissipate small leaks from the facility without the danger of fire or explosion.

SUMMARY OF THE INVENTION

A general object of the present invention is to provide an offshore submarine storage facility for highly chilled liquified energy gases (LEG) and the like which advantageously utilizes the sea environment to overcome the limitations, drawbacks and hazards of prior storage facilities and land based environments.

Another object of the present invention is to provide an offshore submerged storage vessel for LEG which effectively transfers ambient water pressure at considerable depth to the liquified energy gases stored therein to maintain the liquid state.

A further object of the present invention is to provide an external pressure responsive LEG submarine storage vessel which is movable between various depths in the water so that depth-pressure differentials may be used to compensate for temperature changes in the stored liquified energy gas to maintain its liquid state.

Yet another object of the present invention is to provide an external pressure responsive LEG storage vessel which is submerged to a depth in the water at which external pressures equal internal pressures, so that any leaks in the vessel are slowed to the rate of diffusion of dissimilar liquids and are safely dissipated in the water.

A still further object of the present invention is to provide an offshore vessel terminal and storage facility for LEG which is far safer and more secure from natural forces and human interference than LEG storage facilities heretofore known.

One more object of the present invention is to provide an offshore terminal and submarine storage facility for liquid energy gases which favorably compares to land based LEG storage facilities by providing reduced potential for leaks, ruptures, explosions, fires, sabotage, and other natural and manmade hazards, and increased opportunities for safe maintenance and operation.

Still one other object of the present invention is to use natural advantages of an offshore marine and submarine environment for transportation, storage, handling and regassification of LEG.

Yet one more object of the present invention is to provide purification, liquifaction and submarine storage facility at the site of the wellhead tapping an offshore natural gas reserve lying beneath the floor of one of the continental shelves of the oceans of the world.

The present invention accomplishes these foregoing and other apparent objects and advantages by providing an offshore tanker terminal and submarine storage facility for chilled liquified gases, particularly but not limited to liquified natural gas at cryogenic low temperatures. An elongated vertical framework preferably anchored to the sea floor, supports an ambient water pressure responsive insulated storage vessel which may be moved up and down within the framework. The vessel includes an extensible insulated inlet conduit which extends to a terminal platform provided at surface level at the upper end of the framework. An uninsulated outflow conduit to the shore may be used for regassification with ambient sea water temperature functioning to warm the LEG above its boiling point as it passes therethrough. The insulated LEG storage vessel is designed to be made slightly negatively buoyant at the greatest depth of operation and greatest volume of LEG by the introduction of ballast such as sea water into ballast tanks so that the depth of the tank may be effectively controlled.

In one embodiment of the present invention, the storage vessel is in the form of a telescoping, double piston tank characterized by interleaved telescoping double-double cylindrical walls and dome-shaped upper and lower ends. The double-double walls avert the extreme thermal gradient that would otherwise adversely affect single telescoping walls, and they also provide an extra against breaching of the tank wall. Seals are provided between all moving surfaces, or a continuous expansible membrane may be provided inside the tank to provide integrity and minimize leaks. Ballast chambers may be provided in the top of the tank for the introduction and expulsion of ballast. Guides, such as wheels and channels enable the tank to move up and down within the framework much as an elevator is guided in its shaft.

Other objects, advantages and features of the invention will now become apparent from the following detailed description of a preferred embodiment of the present invention which is presented in conjunction with the accompanying drawings.

BRIEF DESCRIPTION OF THE DRAWINGS

In the drawings:

FIG. 2 is a top plan sectional view of the facility taken along the line 2—2 of FIG. 1.

FIG. 3 is an enlarged detail plan view of a side wheel of the LEG storage vessel of the facility shown in FIGS. 1 and 2.

FIG. 4 is a view in side elevation of the telescoping LEG storage vessel of the facility of FIG. 1 shown in a fully contracted position.

FIG. 5 is a view in side elevation and vertical section of the telescoping LEG storage vessel of FIG. 4 shown in a fully expanded position.

FIG. 6 is an enlarged detail view in side elevation and vertical section of a portion of the telescoping double-double wall construction of the top and bottom portions of the LEG storage vessel shown in FIG. 4 and 5.

DETAILED DESCRIPTION OF A PREFERRED EMBODIMENT

Figure 1:
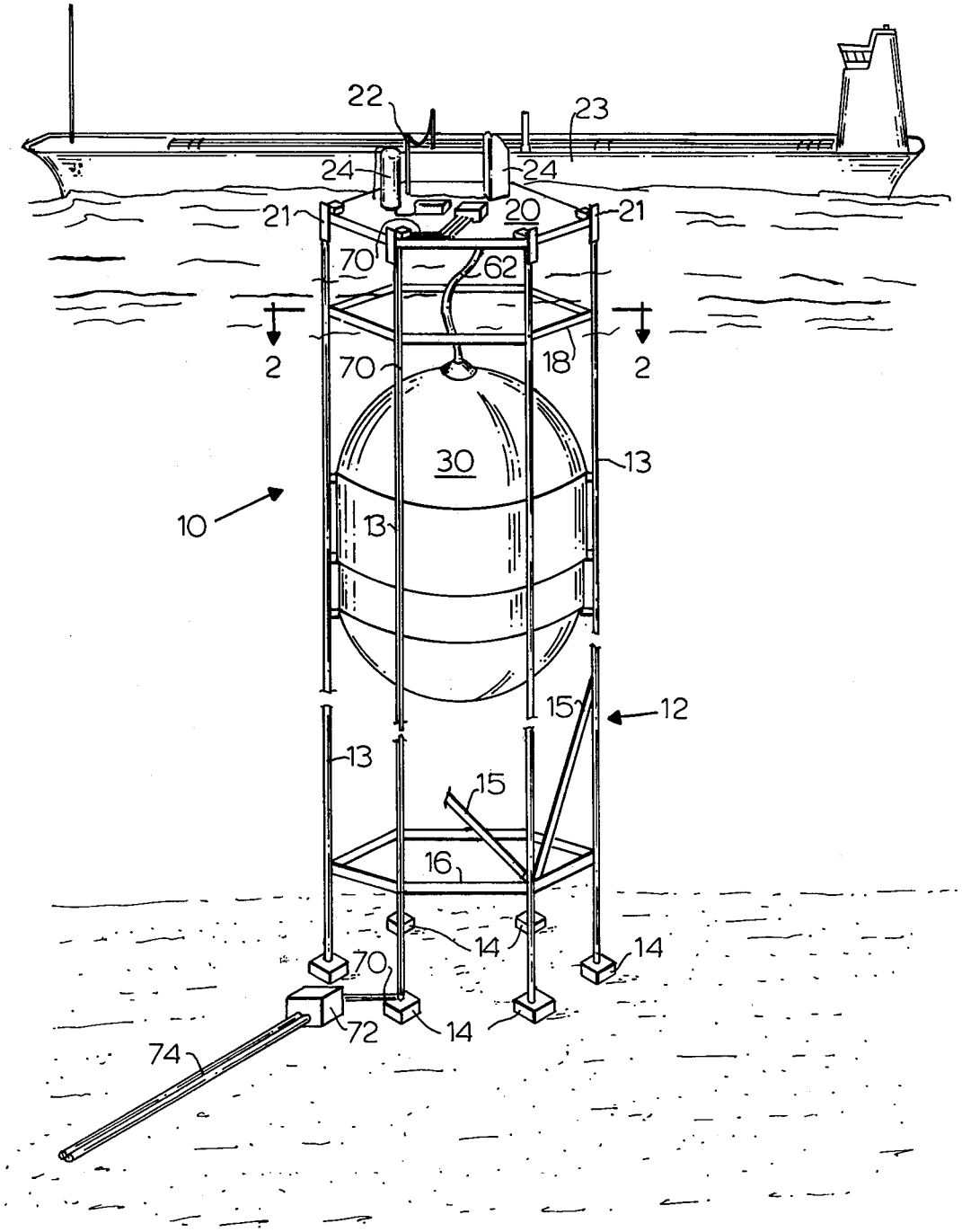
FIG. 1 is a somewhat diagrammatic view in perspective of an offshore liquid energy gas (LEG) terminal and submarine storage facility in accordance with the present invention, the facility being broken in height in order to conserve space.

A liquid energy gas terminal and submarine storage facility 10 in accordance with the principles of the present invention is shown diagrammatically in its intended offshore environment in FIG. 1. While the facility 10 is shown and discussed as constructed in the ocean, it may be used to advantage in any body of water providing there is a sufficient depth available. A large facility, such as the facility 10, works best when the available depth of the ocean floor is at least 400 feet below mean surface level.

The facility 10 includes a framework 12 having six vertical members 13 which are arranged generally to define a hexagon in a horizontal section. The selection of a hexagonal geometry for the framework 12 provides adequate structural support for the facility 10 while minimizing loading resulting from tidal and other currents in the ocean environment. The framework 12 is secured to reinforced concrete pilings 14 which are driven into the floor of the sea. Lower horizontal bracing 16 and upper horizontal bracing 18 connect the vertical members 13 of the framework 12 to provide structural integrity to the facility 10. In practice, triangular members 15, shown broken away in FIG. 1 so as not to obscure the principles of the invention, are also included in accordance with standard structural design practices to interconnect the vertical members 13 of the framework 12 and assure integrity to the framework 12.

A surface level platform 20 is supported at the upper end of the framework 12. The platform 20 is just above the surface of the sea and supports all of the operating controls of the facility 10. The platform 20 provides a dock 21 for mooring large carriers, and transfer equipment 22 for removing liquid energy gas from large draft carriers moored to the dock 21, such as the carrier 23 shown in FIG. 1. The platform 20 also supports reliquefaction equipment 24, living quarters for the operating crew and a heliport for transportation to and from the facility 10.

A two part tank assembly 30 is positioned within the framework 12. The tank assembly 30 is sized and constructed to slide vertically within the framework 12, and is moved up and down to different depths in the water by regulation of its relative buoyancy. Guide wheels 32 are mounted to the sidewall exterior of the tank assembly 30. A bracket 33 provides a suitable, watertight journal for the wheel 32. The guide wheels 32 are aligned to roll within six vertical channels 34 affixed to the vertical members 13 of the framework. An illustrative guide wheel 32, bracket 33, and corresponding vertical channel 34 are shown in FIG. 3.

As there are six vertical members 13 of the framework 12, there are six series of three vertically aligned wheels 32 secured to the outside of the tank assembly 30, with two of the wheels being secured to an upper section 36 of the assembly and one wheel of the vertical series secured to a lower section 38 of the tank assembly 30.

A reinforced insulated implosion dome 40 forms the top of the upper section 36 and a complementary reinforced insulated implosion dome 42 forms the bottom of the lower section 48. Cylindrical double-double walls 44 and 46 of the upper section 36 interleave with complementary cylindrical double-double walls 48 and 50 of the lower section 38 in the fashion shown in FIG. 5 and 6 to provide the telescoping double-double wall construction of the tank assembly 30. Each wall of the walls 44, 46, 48 and 50 is a sandwich construction. Thin outside metal plates 52 and 53 are secured to a rugged but largely open internal frame 54. Insulating material 56 preferably perlite or equivalent fills the spaces and interstices between the exterior plates 52. The members of the interal frame 54 are of very low heat conductivity material to minimize heat transfer through the walls 44, 46, 48 and 50 while providing structural integrity thereto.

Since the temperature gradient (caused by the cryogenic temperatures of the LEG contents of the tank 30) increases with increasing thickness of the wall plates 53, thick plates pose a greater susceptibility to thermal stress failures than do thin but strong plates. Thus, the interior wall plates 53 which physically contact the LEG are preferably formed of a thin aluminum or nine percent (9%) nickel-steel alloy and constructed in the manner described (by Tiratsoo in *Natural Gas*, 1972 Ed., pages 200–202) as a "membrane" tank. By "membrane" is meant those characteristics of thinness in comparison to major surface area and flexibility in a plane perpendicular to the major surface. Membrane qualities enable the interior tank wall plates 53 to adjust to pressure ratio variations as the tank assembly is filled and drained of LEG, and as it moves to different depths. Exterior wall plates 52 are preferably constructed of stainless steel and are overcoated with a thin anti-corrosion marine copolymer resin material which remains pliant, flexible and somewhat elastic after polymerization (setting).

The double-double walls 44, 46, 48 and 50 are provided with continuous peripheral annular seals 55 at the outer ends thereof which prevent the escape of liquified energy gases from the tank 30 and which prohibit intrusion of water from the outside. While the seals 55 remain functional over a substantial pressure gradient, and at low cryogenic temperatures, it will be appreciated that exterior water pressure and interior LEG pressures will be substantially equalized in the storage operation of the facility 10.

A spring loaded locking dog 59 may be provided in the interleaved side wall construction, as shown in FIG. 6, to assure that the upper and lower portions 36 and 38 of the tank 30 do not separate when the position of maximum extension is reached, as shown in FIG. 5.

Referring now to FIGS. 4 and 5, the reinforced upper dome 40 of the tank 30 includes a ballast chamber 57 which is alternatively flooded with and purged of water to alter the buoyancy of the tank assembly 30 in order to raise or lower it in accordance with instructions from an automatic computer control system that continuously monitors the volume and state of the liquid energy gas inside the tank assembly 30 and compensates for the monitored conditions by adjusting the ballast. The ballast chamber 57 includes vents 58 to the outside, shown in FIG. 4, which are opened and closed, as in a submarine, to control the flow of water and purging gas into and out of the ballast chamber 57. The blowing of the ballast out of the chamber 57 would be accomplished by suitable equipment provided in an external housing 60 mounted on the upper dome 40 of the assembly 30. The ballast control equipment in the housing 60 is connected to the computer control system and adjusts the ballast in the chamber 57 under automatic control of the computer. While the ballast chamber 57 is shown to be in the upper dome 40, such chambers may be provided in the bottom dome 42 as well, or alternatively to placement in the upper dome 40. The chamber 57 must be placed on the outside of the insulation so that the low temperatures of the LEG within the tank 30 do not reach the ballast water and cause it to freeze.

Since liquified natural gas, for example, is only 42 percent the density of water, the greater the quantity of LNG stored in the tank assembly 30, the greater will be its buoyancy. Consequently, the quantity of liquified energy gas, e.g., LNG, stored in the tank 30 will dictate the quantity of ballast required to keep the tank assembly 30 at the desired depth. This depth will also depend upon the temperature of the LEG in the tank. As temperature rises, liquid state may be maintained by additional pressure. Since pressure increases with depth, due to the weight of water above, this phenomenon is used to and in keeping the LEG liquified. Thus, the tank assembly 30 is ballasted to an appropriate depth to provide the desired pressure to the LEG. The whole ballasting operation is highly dynamic, and the computer control system is therefor highly desirable to control overall storage operation of the facility 10.

Transfer of the liquid energy gas into and out of the tank 30 is accomplished through a somewhat flexible, insulated connecting pipe 62 which extends from the platform 20 to a suitable entry point 64 in the upper dome 40 of the tank assembly 30. The connecting pipe 62 extends into the interior of tank 30 to a point which approaches the bottom dome 42 thereof in the fully retracted position as shown in FIG. 4. The upper end of the pipe 62 is connected to the transfer equipment 24 located topside on the platform 20.

A reserve safety cutoff valve 66 located inside of the cryogenic wall of the upper implosion dome 40 provides a safety backup to the valve apparatus located at the transfer equipment 44 at the platform 20. Additionally, two emergency high pressure bleeder valves 68 are provided adjacent the reserve safety cutoff valve 66 in the top of the dome 40 to remove gases boiled off from the liquified energy gas in event of regassification within the tank 30.

Transfer of liquid energy gas from the tank 30 to an onshore delivery location is preferably by way of an insulated pipeline 70 which extends from the transfer equipment 24 downwardly along the framework 12 to a transfer station 72 installed on the floor of the ocean. At the transfer station, the liquified energy gas is passed into non-insulated pipelines 74 which extend to conventional gas distribution equipment located on the shore. These uninsulated pipes 74 effectively transfer the relative warmth of the sea water to the liquified gas to accomplish regassification in accordance with techniques which are known in the art and form no part of the present invention. Suitable pressure regulators and automatic shutdown sensors are provided at the transfer station 72 to control the regassification operation of the facility 10.

While in theory the tank assembly 30 does not need to be anchored within the framework 12 by any cables or ratchet-pawl mechanisms engaging the framework 12, safety considerations may require the use of such elements, and cables or other mechanisms, not shown, would function to hold the tank assembly 30 at a given level and provide a redundancy of safety in the event that the valves 58 controlling the ballast chamber 56 were to malfunction. Also, cables could be used to pull the tank assembly 30 down to an appropriate level, in the event of a complete failure of the ballast system.

Practical size limits exist for minimum and maximum tank volume. Minimum volume would be an economic constraint below which storage of LEG would not be commercially feasible. Maximum tank volume is reached at that point at which the buoyancy to ballast ratio becomes untenable. In practice, it is expected that tank volume will be between 50,000 and 325,000 U.S. barrels.

The facility 10 is constructed first by emplacement of the concrete pile footings 14. Then, the frame 12, preferably fabricated on shore, with the tank assembly 30 in place, is floated to the offshore site, the empty tank 30 providing most of the flotation required for this journey. The frame and tank are then submerged in a vertical orientation, and the vertical members 13 anchored to the footings 14.

The frame 12 may be designed without the above-surface platform 20 and dock 21 and provide an entirely submerged storage facility, having a floating transfer buoy for supporting the upper terminal end of the insulated conduit 62. The arrangement works well in rough waters and facilitates all weather, all conditions loading of the tank assembly 30.

Multiple tank farms may readily be provided by arranging plural frames such that some vertical members thereof support and guide two tank assemblies on opposite sides. The hexagonal framework 12 is particularly well adapted to provide multiple tank farms.

Those skilled in the art will appreciate that the present invention overcomes many significant drawbacks of prior art liquified energy gases storage facilities by providing a storage facility which greatly reduces site costs, and eliminates land buffer zone costs, which eliminates shore side dredging and ship building facilities costs, which uses the offshore submarine environment for maintenance of the liquid state of the stored LEG, for safe dispersal of leaked LEG without fire or explosion hazards, and for convenient regassification during transfer to shore.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

We claim:

1. An offshore submarine storage facility in the ocean and the like for liquified energy gases and similar liquid materials at cryogenic temperatures, comprising:

vertically compressible insulated submarine storage tank means positionable at various depths in the water for storing said liquid materials, said tank means including ambient water pressure transfer means for transferring external ambient water pressures having a gradient related to the vertical dimension of said tank means to the liquified material stored therein without intermixture of water and liquified material so that said transferred pressure aids in maintaining the liquid state of said liquid material and so that a desired pressure gradient may be obtained by varying the depth of said tank means in the water, said tank means including positioning means for enabling ascent and descent of said tank means in the water to selected depths to maintain liquid state during storage.

2. An offshore, submarine storage facility in the ocean and the like for liquid energy gases and the like at cryogenic liquifying temperatures, said facility comprising:

frame means in the sea aligned in a generally vertical orientation;

insulated tank means mounted to move up and down within said frame means, said tank means including:

positioning means for moving said tank means up and down within said frame means to various selected storage depths in the sea, sea pressure transfer means for transferring ambient sea pressure at selected depths at which said tank means is positioned from time to time to the contents stored in said tank means to provide ambient pressure at said selected depth to said contents so as to promote and maintain liquid state thereof, volume expansion and contraction means for expanding and contracting the interior storage volume of said tank means vertically in accordance with the volume of liquid stored therein and ambient external pressure gradient applied from time to time, insulated flexible transfer conduit means extending from the surface of the sea to said tank means for transferring liquid to and from said tank means.

3. An offshore submarine storage facility in the ocean and the like for chilled liquid energy gases and the like comprising:

a frame submerged in the body of water and extending upwardly therein, insulated tank means mounted to move up and down within said frame to various storage depths in the water, said tank means including external ambient water pressure transfer means for transferring external ambient pressure to the liquid stored within said tank means without intermixture, said tank means defining volume expansion and contraction means for expanding and contracting the interior storage volume of said tank means vertically in accordance with the volume of liquid stored therein and external ambient pressure applied from time to time, insulated extensible transfer conduit means from said tank means to terminal means at the surface of the water for transferring liquid to and from said tank means, positioning means for moving said tank means up and down to various storage depths in the water selected to provide liquid state maintaining ambient pressure to said liquid, whereby external ambient water pressure gradient transferred to said stored liquid aids in maintaining liquidity and inhibiting gassification of said liquid.

4. A submarine liquified gas storage facility in the ocean and the like for handling and storing liquified gases at cryogenic temperatures, said facility comprising:

thermally insulated, submarine, vertically telescoping seal-providing piston-in-cylinder tank means for receiving and storing liquified gas in liquid state therein at cryogenic temperatures without intermixture of ambient water;

variable buoyancy means attached to said tank means for enabling said tank means to ascend and descend in the water to selected depths during handling and storage operations thereby applying external ambient water pressure gradient through said tank means to said liquified gas in an amount selected to promote and maintain the liquid state thereof.

5. A submarine liquified gas storage facility for handling and storing liquified gases at cryogenic temperatures, said facility comprising:

an elongated submarine vertical frame;

thermally insulated, submarine, vertically telescoping seal-providing piston-in-cylinder tank means slidably mounted to move up and down on said frame for receiving and storing liquified gas in liquid state therein at cryogenic temperatures without intermixture of ambient water;

variable buoyancy means attached to said tank means for enabling said tank means to ascend and descent in the water to selected depths during handling and storage operations thereby applying external ambient water pressure gradient through said tank means to said liquified gas in an amount selected to promote and maintain the liquid state thereof.

6. A submarine liquified gas storage facility for handling and storing liquified gases at cryogenic temperatures, said facility comprising:

thermally insulated, submarine, tank means for receiving and storing liquified gas in liquid state therein at cryogenic temperatures without intermixture of ambient water, said tank means comprising a two part vertically telescoping closed vessel, each part including a continuous double wall telescoping portion in a sealed sliding engagement with a complementary portion of the other such part;

variable buoyancy means attached to said tank means for enabling said tank means to ascend and descend in the water to selected depths during handling and storage operations thereby applying external ambient water pressure gradient through said tank means to said liquified gas in an amount selected to promote and maintain the liquid state thereof.

7. The storage facility set forth in claim 6 wherein said continuous double wall portions are substantially cylindrical and where the end portions of said vessel are generally concavo-convex.

8. The storage facility set forth in claim 7 wherein said variable buoyancy means includes ballast tanks provided in the end portions of said vessel.

9. A submarine liquified gas storage facility for handling and storing liquified gases at cryogenic temperatures, said facility comprising:

thermally insulated, submarine, vertically telescoping seal-providing piston-in-cylinder tank means for receiving and storing liquified gas in liquid state therein at cryogenic temperatures without intermixture of ambient water;

variable buoyancy means provided in the end wall structure of said tank means for enabling said tank means to ascend and descend in the water to selected depths during handling and storage operations thereby applying external ambient water pressure gradient through said tank means to said liquified gas in an amount selected to promote and maintain the liquid state thereof.

10. A submarine liquified gas storage facility for handling and storing liquified gases at cryogenic temperatures, said facility comprising:

thermally insulated, submarine, vertically telescoping seal-providing piston-in-cylinder tank means for receiving and storing liquified gas in liquid state therein at cryogenic temperatures without intermixture of ambient water;

variable buoyancy means attached to said tank means for enabling said tank means to ascend and descend in the water to selected depths during handling and storage operations thereby applying external ambient water pressure gradient through said tank means to said liquified gas in amount selected to promote and maintain the liquid state thereof;

conduit means communicating with said tank means and having an uninsulated portion extending through the water for transferring heat from the water to the liquified gas to obtain regassification during outflow of liquified gas from said tank means.

11. A submarine liquified gas storage facility in a body of water for handling and storing liquified gases at cryogenic temperatures, said facility comprising:

an elongated substantially submarine vertical frame anchored to the floor of the body of water;

thermally insulated, submarine, vertically compressible tank means slidably mounted to move up and down on said frame, for receiving and storing liquified gas in a liquid state therein at cryogenic temperatures without intermixture of ambient water;

variable positioning means attached to said tank means for enabling said tank means to ascend and descend in the water to selected depths during handling and storage operations thereby applying external ambient water pressure gradient through said tank means to said liquified gas in an amount selected to promote and maintain the liquid state thereof;

said vertical frame having a platform portion above the surface of the water forming a dock for anchoring ships, barges and other waterborne shipping media for liquified gas;

extensible conduit means communicating between said platform and said tank means for passing said liquified gases to and from said tank means at cryogenic temperatures.

12. A submarine liquified gas storage facility in a body of water for handling and storing liquified gases at cryogenic temperatures, said facility comprising:

thermally insulated, submarine, vertically telescoping double piston tank means for receiving and storing liquified gas in liquid state therein at cryogenic temperatures without intermixture of ambient water;

positioning means attached between said tank means and the floor of said body of water for enabling said tank means to ascend and descend in the water to selected depths during handling and storage operations thereby applying external ambient water pressure gradient through said tank means to said liquified gas in an amount selected to promote and maintain the liquid state thereof.

* * * * *